US010273645B2

(12) United States Patent
Pan et al.

(10) Patent No.: US 10,273,645 B2
(45) Date of Patent: Apr. 30, 2019

(54) INFLATABLE DAM AND METHOD THEREOF

(71) Applicant: HTE Engineering LLC, Sandy, UT (US)

(72) Inventors: Dong Pan, Sandy, UT (US); David Sanders, West Jordan, UT (US)

(73) Assignee: HTE Engineering LLC, Sandy, UT (US)

( * ) Notice: Subject to any disclaimer, the term of this patent is extended or adjusted under 35 U.S.C. 154(b) by 0 days.

(21) Appl. No.: 15/853,187

(22) Filed: Dec. 22, 2017

(65) Prior Publication Data

US 2018/0179716 A1 Jun. 28, 2018

Related U.S. Application Data

(60) Provisional application No. 62/438,347, filed on Dec. 22, 2016.

(51) Int. Cl.
*E02B 7/20* (2006.01)
*E02B 3/10* (2006.01)

(52) U.S. Cl.
CPC ..... *E02B 7/20* (2013.01); *E02B 3/102* (2013.01)

(58) Field of Classification Search
CPC combination set(s) only.
See application file for complete search history.

(56) References Cited

U.S. PATENT DOCUMENTS 1,561,759 A * 11/1925 Wetmore ..... B60C 9/16 152/202
3,067,712 A 12/1962 Doerpinghaus
3,173,269 A 3/1965 Imbertson
3,355,851 A 12/1967 Imbertson et al.
3,496,686 A 2/1970 Bird
4,299,514 A * 11/1981 Muramatsu ..... E02B 7/005 405/107
4,318,634 A 3/1982 Borca
4,352,591 A 10/1982 Thompson
4,661,015 A 4/1987 Tsuji et al.
4,728,221 A 3/1988 Tsuji et al.
4,787,774 A 11/1988 Grove
4,906,134 A 3/1990 Hoyeck
4,909,666 A * 3/1990 Takasaki ..... E02B 7/005 405/107
5,046,289 A 9/1991 Bengel et al.
5,205,886 A * 4/1993 White ..... B29C 63/34 138/145
5,257,968 A 11/1993 Caldwell
5,261,869 A 11/1993 Caldwell et al.
5,354,255 A 10/1994 Shapiro
5,538,360 A 7/1996 Obermeyer
5,833,387 A 11/1998 Tackney
(Continued)

*Primary Examiner* — Kyle Armstrong
(74) *Attorney, Agent, or Firm* — David L. Stott

(57) ABSTRACT

An inflatable dam sized to secure to a foundation structure. The inflatable dam includes a double layered flexible membrane extending with an inner membrane and an outer membrane, the double layered flexible membrane including a port configured to facilitate inflation and deflation of the inner membrane such that, upon inflation of the inner membrane, the outer membrane is configured to expand with inflation of the inner membrane, the outer membrane including a reinforcement element embedded therein.

22 Claims, 6 Drawing Sheets

(56) References Cited

U.S. PATENT DOCUMENTS

| | | | | |
|---|---|---|---|---|
| 6,179,521 | B1 | 1/2001 | Muramatsu et al. | |
| 6,354,762 | B1 | 3/2002 | Muramatsu | |
| 6,467,999 | B2 | 10/2002 | Muramatsu et al. | |
| 6,481,928 | B1 * | 11/2002 | Doolaege ..... | E01D 15/20 138/98 |
| 6,485,230 | B2 | 11/2002 | Robinson | |
| 6,546,723 | B1 | 4/2003 | Watten et al. | |
| 6,565,284 | B2 | 5/2003 | Gearhart | |
| 6,609,854 | B2 | 8/2003 | Okazaki | |
| 6,886,407 | B1 | 5/2005 | Fredenberg | |
| 6,960,181 | B2 | 11/2005 | Stevens | |
| 7,114,879 | B2 | 10/2006 | Obermeyer | |
| 7,670,083 | B2 | 3/2010 | McWha | |
| 7,708,495 | B1 | 5/2010 | Antee | |
| 7,989,973 | B2 | 8/2011 | Birkestrand | |
| 8,511,937 | B2 | 8/2013 | Obermeyer et al. | |
| 9,028,170 | B2 | 5/2015 | Obermeyer et al. | |
| 9,157,226 | B2 | 10/2015 | Hassett | |
| 9,217,233 | B2 | 12/2015 | Behm et al. | |
| 9,297,136 | B2 | 3/2016 | Lee et al. | |

* cited by examiner

INFLATABLE DAM AND METHOD THEREOF

CROSS-REFERENCE TO RELATED APPLICATION

The present application claims the benefit of U.S. Provisional Patent Application Ser. No. 62/438,347, filed Dec. 22, 2016, entitled INFLATABLE DAM AND METHOD THEREOF, the disclosure of which is incorporated by reference herein in its entirety.

TECHNICAL FIELD

The present invention relates generally to an apparatus for blocking the flow of water and, more specifically, the present invention relates to inflatable type dams for blocking the flow of water.

BACKGROUND

Dams and gate structures of a permanent nature typically made of cement and mortar to block or partially block the flow of water have been employed for ages. In the last several decades, collapsible or inflatable dams have been designed and employed for certain water way systems. These inflatable dams are typically made of a rubber membrane and secured to a reinforced concrete foundation and are far less costly than the cement and mortar permanent dams. Similar to the more conventional permanent dams, inflatable dams may be used for a wide variety of applications, such as irrigation, water storage, power generation, flood prevention and control, erosion control, groundwater recharge, tidal barriers, navigation, sewage treatment, etc.

The advantages of rubber dams over the more conventional permanent dam structures include considerable savings on cost of construction materials, simplified and more time efficient construction and installation, lower operation and maintenance costs, more simplified and low cost operating systems, readily deflatable to pass high flows without any obstruction, and high pressure compressors are not needed to run the dam system. Further, rubber dams are more reliable relative to leaking seals and work well in cold temperatures without the need to de-ice and do not have issues of jamming mechanical parts. Furthermore, lubrication of moving parts is not necessary and painting components for environmental protection is not required. In addition, rubber dams can readily adapt to potential differential settlement of the foundation and can easily absorb impacts, shocks, and vibrations.

However, due to the inflatable structure of rubber dams, the rubber membranes are relatively thin, making them susceptible to punctures due to potential sharp passing debris flowing over the dam or even sharp objects of vandalism. As such, it would be advantageous to provide an inflatable dam that will be less susceptible to sharp objects, such as from passing debris and instruments of vandalism.

BRIEF SUMMARY OF THE INVENTION

The present invention is directed to an inflatable dam for securing to a foundation structure. In one embodiment, the inflatable dam includes an elongated inner member and an elongated outer member. The elongated inner member is configured to extend between upward extending walls of the foundation. The elongated outer member is configured to extend between the upward extending walls of the foundation. The elongated inner member is configured to be inflated within the elongated outer member such that the outer member substantially surrounds the elongated inner member. The elongated outer member includes a reinforcement element embedded therein.

In another embodiment, the reinforcement element includes a metallic mesh element. In another embodiment, the reinforcement element extends through the elongated outer member such that the reinforcement element substantially surrounds an outer surface of the elongated inner member. In another embodiment, the reinforcement element includes a high strength polymeric material. In another embodiment, the reinforcement element includes a high strength fabric.

In another embodiment, the inner member includes an inner fin structure extending along a length of the inner member and sized to align and correspond with an elongated channel defined along an interior surface of the outer member. In another embodiment, the outer member includes a fin structure extending along a length of an exterior surface of the outer member, the fin structure defining an elongated crevice extending along an underside of the fin structure along an interior side of the outer member. In another embodiment, the inner member includes an inner fin structure sized to be aligned and positioned along the crevice defined in the outer member.

In another embodiment, the inner member and the outer member include a polymeric material. In yet another embodiment, the inner member includes a woven polyester reinforcing material embedded within a rubber membrane. In another embodiment, the outer member is secured to the foundation with an anchor line.

According to another embodiment of the present invention, an inflatable dam for securing to a foundation is provided. The inflatable dam includes a double layered flexible membrane extending with an inner membrane and an outer membrane. The double layered flexible membrane includes a port configured to facilitate inflation and deflation of the inner membrane such that, upon inflation of the inner membrane, the outer membrane is configured to expand with inflation of the inner membrane. The outer membrane includes a reinforcement element embedded within the outer membrane.

In another embodiment, the reinforcement element includes a woven steel wire mesh element. In still another embodiment, the reinforcement element includes a metallic mesh element. In another embodiment, the outer membrane surrounds an entire outer surface of the inner membrane. In yet another embodiment, the reinforcement element surrounds an entire outer surface of the inner membrane. In another embodiment, the inner membrane includes a fabric-reinforced rubber membrane. In another embodiment, the reinforcement element includes a high strength polymeric material. In another embodiment, the reinforcement element includes a high strength fabric.

In another embodiment, the outer membrane includes a fin structure extending along a length of an exterior surface of the outer membrane, the fin structure defining an elongated crevice extending along an underside of the fin structure and along an interior side of the outer membrane. In another embodiment, the inner membrane includes an inner fin structure sized to be aligned and positioned along the crevice defined in the outer membrane.

In accordance with another embodiment of the present invention, a method for damming water flow is provided. The method includes: providing a double layered flexible membrane over a foundation structure, the double layered flexible membrane having an inner membrane and an outer membrane, the outer membrane having a reinforcement element embedded therein such that the reinforcement element substantially surrounds the inner membrane, the double layered flexible membrane coupled to the foundation; and inflating the double layered flexible membrane through a port defined therein.

In another embodiment, the method of inflating includes maintaining alignment of the inner membrane with the outer membrane with an inner fin structure extending along a length of the inner membrane to be positioned within a crevice defined along an interior surface of the outer membrane. In another embodiment, the method of providing includes the method step of providing the reinforcement element to extend with a metallic mesh. In another embodiment, the method of providing includes providing the reinforcement element to extend with a high strength polymeric material. In still another embodiment, the method of providing includes providing the reinforcement element to extend with a high strength fabric.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
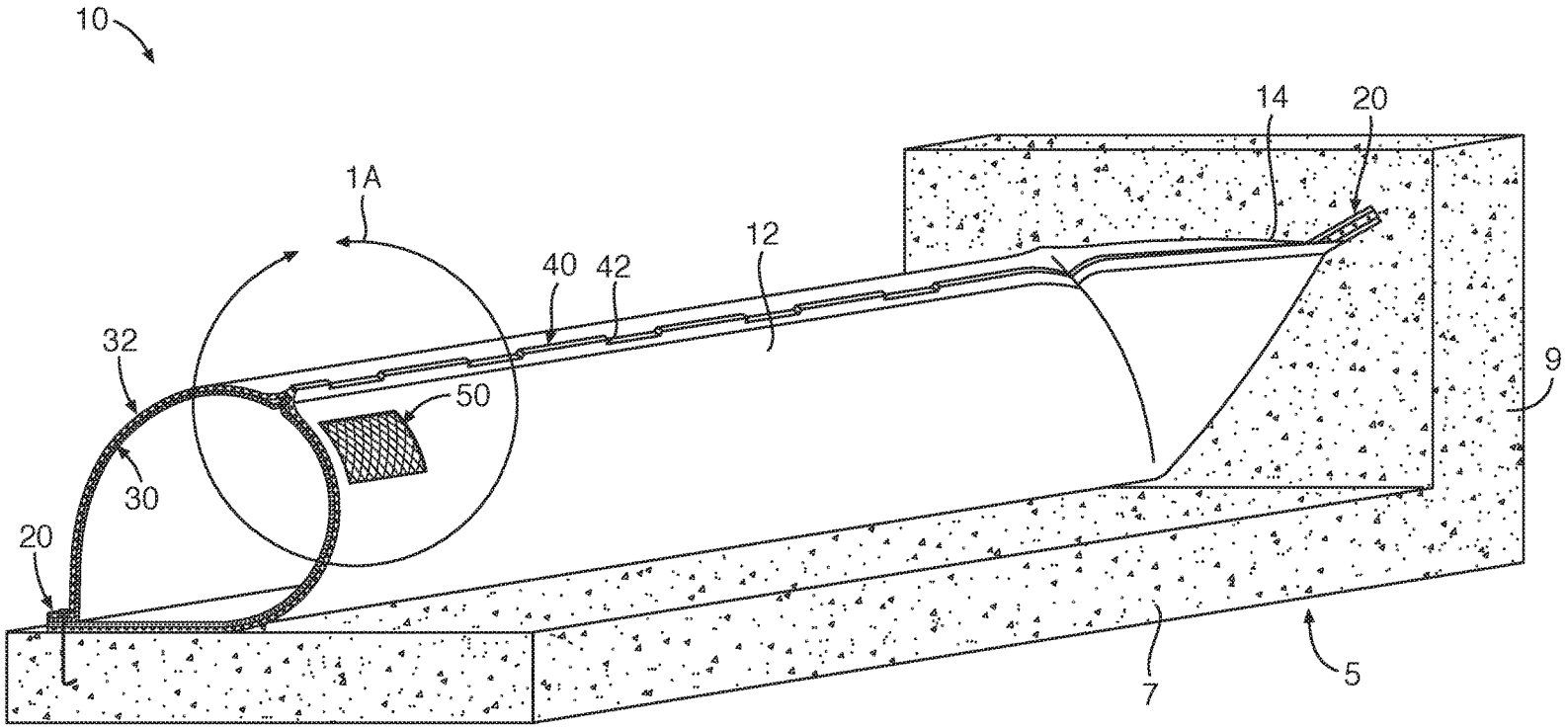
FIG. 1 is a cross-sectional perspective view of an inflatable dam, depicting the inflatable dam having multiple layers, according to one embodiment of the present invention.

Referring to FIG. 1, an inflatable dam 10 that may be positioned and secured to a foundation structure 5 is provided. The inflatable dam 10 is depicted in perspective view with one end of the inflatable dam 10 shown in cross-section to illustrate a structure of the inflatable dam 10. The inflatable dam 10 may be positioned and secured to a horizontal foundation portion 7 and between upstanding foundation portions 9. The inflatable dam 10 may be sized and configured to be readily moved between a deflated position (FIG. 4) and an inflated position such that, in the inflated position, the inflatable dam 10 may be employed to block or partially block the flow of water. Further, the inflatable dam 10 may be sized and configured to be puncture resistant in a manner to substantially prevent the inflatable dam 10 from being damaged by sharp objects, such as from passing debris or instruments of vandalism.

Figure 2:
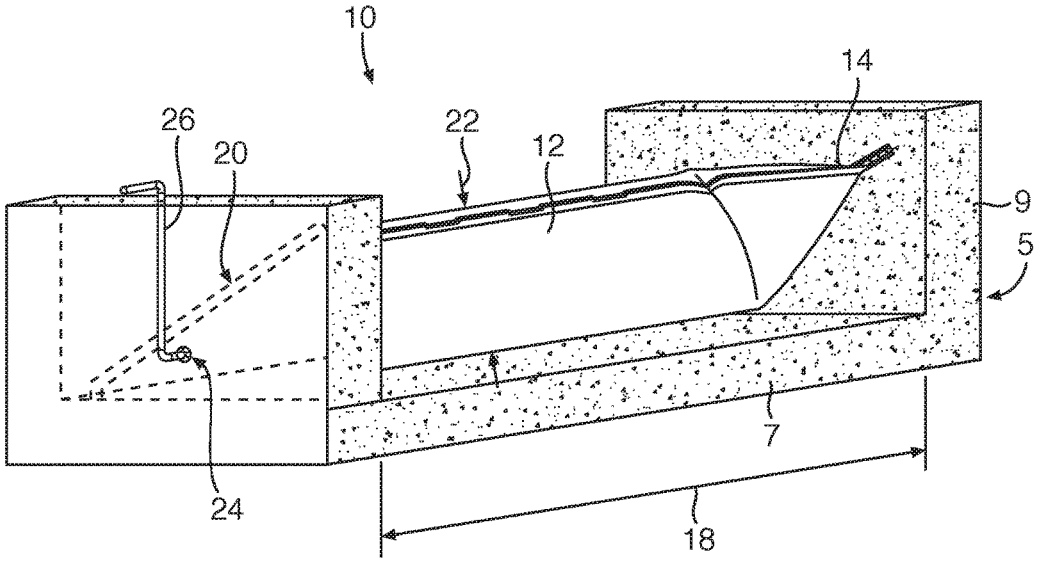
FIG. 2 is a perspective rear view or downstream view (viewing from downstream) of the inflatable dam in an inflated position, according to another embodiment of the present invention.
Figure 3:
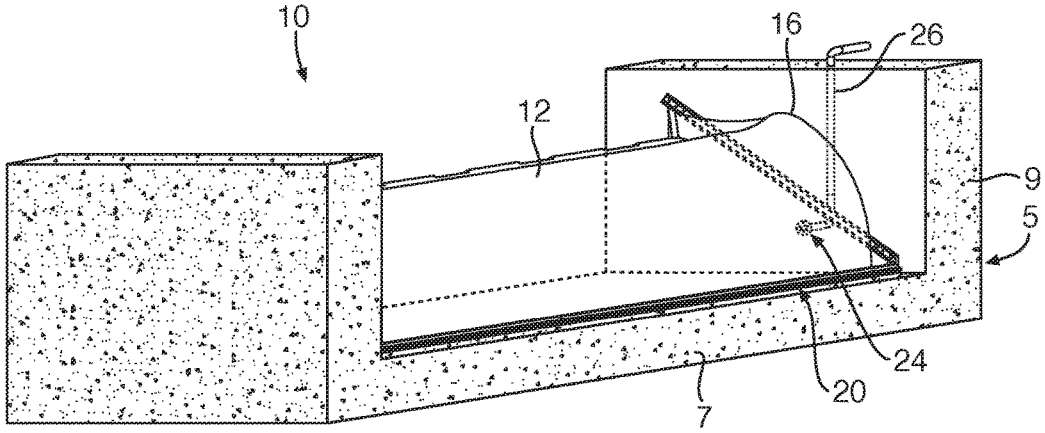
FIG. 3 is a perspective front view or upstream view (viewing from upstream) of the inflatable dam in the inflated position, according to another embodiment of the present invention.

With respect to FIGS. 1, 2 and 3, the inflatable dam 10 may extend with an elongated structure 12 so as to define a bladder. Such inflatable dam 10 may exhibit a cylindrical or tubular configuration. The elongated structure 12 of the inflatable dam 10 may extend between and terminate at a first end 14 and a second end 16 so as to define a longitudinal length 18 along the elongated structure 12. The inflatable dam 10 may also define a width 22 or a diameter. The first end 14 and the second end 16 of the inflatable dam 10 may be secured to opposite upstanding foundation portions 9 (that may extend vertically or at a slope, for example) with an anchor line 20, discussed further herein. Similarly, the inflatable dam 10 may be secured to the horizontal foundation portion 7 with the anchor line 20 extending along the length 18 of the inflatable dam 10 and along one side of the inflatable dam 10. In the inflated position, the elongated structure 12 of the inflatable dam 10 may extend to exhibit the tubular structure substantially along the length of the inflatable dam so as to narrow and close-off at the anchor line 20 along the first and second ends 14, 16 of the inflatable dam 10. It should be noted that the inflatable dam 10 may be sized to meet the requirements of a given water way such that the length and width depicted in FIGS. 2 and 3 is only provided by way of example since such dimensions may extend much longer or shorter depending upon the given requirements of a water way.

FIGS. 2 and 3 depict portions of the inflatable dam 10 and the foundation structure 5 in transparent form to depict a port and tubing arrangement, in simplified form, positioned at one end of the inflatable dam 10. For example, the inflatable dam 10 may define a port 24 sized and configured to facilitate inflation and deflation of the inflatable dam 10. The inflatable dam 10 may be inflated with air or water, or any other suitable fluid or combination of fluids. The port 24 may be defined adjacent to, for example, the second end 16 of the inflatable dam 10. The port 24 may be coupled to tubing 26 such that the tubing 26 may extend from the port 24 and through one of the upstanding foundation portions 9. Such tubing 26 may include various bends to extend through a top side of the upstanding foundation portion 9. In another embodiment, the tubing 26 may continue horizontally from the port 24 to an exterior surface of the foundation structure 5. In this manner, the port 24 and tubing 26 of the inflatable dam 10 may be employed for readily inflating and deflating the dam with, for example, a pumping or compressor system (not shown) or the like. As indicated, the port 24 and tubing 26 arrangement is depicted in simplified form, but may be any suitable port 24 and tubing 26 arrangement known to one of ordinary skill in the art that facilitates inflation and deflation of the inflatable dam 10.

Figure 1A:
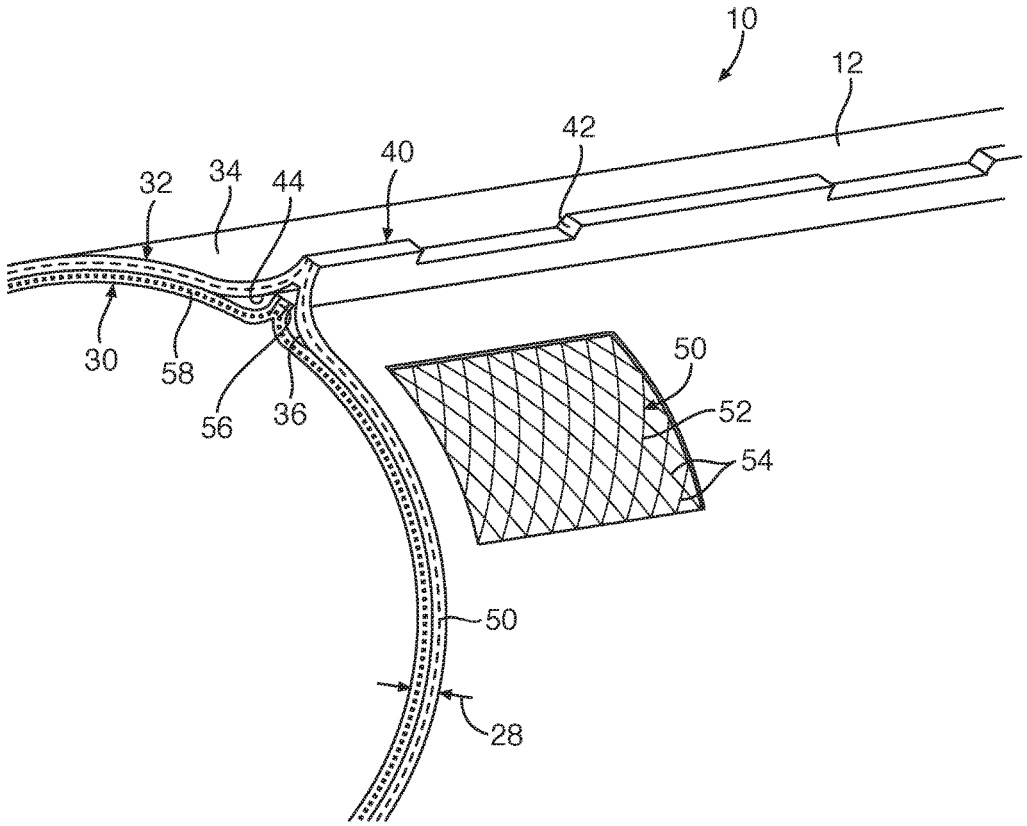
FIG. 1A is an enlarged view of the inflatable dam taken from section 1A of FIG. 1, depicting a cut-out portion of the inflatable dam, according to another embodiment of the present invention.

With reference to FIGS. 1 and 1A, the bladder or elongated structure 12 of the inflatable dam 10 may include a double layered flexible membrane. Such double layered flexible membrane may define a depth 28. In one embodiment, the inflatable dam 10 may include an inner member 30 or inner membrane and an outer member 32 or outer membrane each extending longitudinally along the length to form the elongated structure 12 such that the outer member 32 surrounds the inner member 30. The inner member 30 and outer member 32 positioned adjacent each other may define the depth 28 along the perimeter of the elongated structure 12. In one embodiment, the outer member 32 and the inner member 30 may be a polymeric material, such as rubber. In another embodiment, the outer member 32 and the inner member 32 may be a vulcanized neoprene/EPDM ("Ethylene Propylene Diene Monomer") rubber or any other suitable polymeric material known in the art.

The outer member 32 may define an exterior surface 34 and an interior surface 36, the exterior surface 34 being an exterior side of the inflatable dam 10 that may be exposed to passing debris and the like. The outer member 32 may define a fin structure 40, which may best be depicted in the inflated position. The fin structure 40 may be a seam for the outer member 32 such that the fin structure 40 may be formed by securing two interior surfaces 36 of two portions of the outer member 32 together with, for example, a heating process as known in the art or any other suitable process for securing two portions of the outer member 32 together to create a seam that defines the fin structure 40. The fin structure 40 may also define notches 42 formed therein, the notches 42 spaced along at least a portion of the length of the seam. The fin structure 40 may also define a crevice 44 or channel along an underside of the fin structure 40 or along the interior surface 36 of the fin structure 40 of the outer member 32. At the exterior side, such fin structure 40 and notches 42 may be employed to break-up or deflect the flow of water over the inflatable dam 10.

Further, the outer member 32 may include a reinforcement element 50. The reinforcement element 50 may be embedded within the outer member 32, as shown in cut-out portion of FIG. 1A. In one embodiment, the reinforcement element 50 may be a single layer of reinforcement material. In another embodiment, the reinforcement element 50 may include multiple layers spaced and embedded or adjacently stacked and embedded in the outer member 32. The reinforcement element 50 may be sized and configured to resist punctures. The reinforcement element 50 may extend substantially through the outer member 32, in an embedded manner, along the length and width of the outer member 32 such that the reinforcement element 50 may correspond with and be substantially the same size as the outer member 32. In this manner, the reinforcement element 50 may completely surround the inner member 30 since the outer member 32 surrounds the inner member 30. Further, the reinforcement element 50 may extend within the outer member 32 such that such reinforcement element 50 is disposed between the exterior surface 34 and the interior surface 36 of the outer member 32, or in other words, the reinforcement element 50 may be embedded within the outer member 32. The reinforcement element 50 may be a high-strength element, such as a metallic material or a high strength polymeric material.

In one embodiment, the reinforcement element 50 may be a wire mesh 52 or mesh material. In a further embodiment, the wire mesh 52 may be a steel wire mesh member. In another embodiment, the reinforcement element 50 may be a metallic material, such as steel, or any other suitable metallic material. In another embodiment, the wire mesh 52 may be woven or a unitary seamless member or may include a unitary portion with additional wires woven therethrough. In another embodiment, the reinforcement element 50 may define a mesh structure or a multi-cellular structure. In another embodiment, the mesh structure or the multi-cellular structure may define struts 54 extending to define cells. The struts 54 defining each cell may be about 1 inch in length or may be smaller or larger, such as in the range between about 0.5 inches and about 1.5 inches, as desired. In another embodiment, the struts 54 defining each cell of the reinforcement element 50 may be within the range between about 0.25 inches and about 1.5 inches, or within the range between about 0.1 inch and about 2 inches. As set forth, in one embodiment, the reinforcement element 50 may be a polymeric material, such as a para-aramid, meta-aramid, or copolyamide, or the like or any other high strength polymeric material that may include high strength fibers or may be in the form of fabric or the like, or any other material suitable for embedding within the outer member 32 that will resist and protect the inner member 30 from sharp debris or instruments of vandalism.

In still another embodiment, the reinforcement element 50 may be similar to a mesh, but without the cross-member, such that the reinforcement element 50 may extend with multiple parallel cables that may be substantially evenly spaced relative to each other and embedded within the outer member 32, similar to that previously set forth. The laterally spaced distance between the parallel extending cables may be similar to the ranges for the length of the struts 54 defining the cells previously described for the wire mesh 52. In one embodiment, the cables may be in the form of cord or wires or the like. In another embodiment, such multiple parallel cables may be braided steel cables embedded in the outer member 32. In another embodiment, the multiple parallel cables may be polymeric cables, extending in a braided, woven, cord or wire like manner. In another embodiment, the multiple parallel cables may extend in an elongated manner so as to extend substantially parallel relative to a length 92 (FIG. 8) of the outer member 32. In another embodiment, the multiple parallel cables may extend in an elongated manner so as to extend laterally (at any orientation) relative to the length 92 of the outer member 32. In yet another embodiment, the multiple parallel cables may extend in an elongated manner so as to extend substantially perpendicular relative to the length 92 of the outer member 32.

The inner member 30 may be disposed within the outer member 32. The inner member 30 may be employed as a bladder for holding an inflation medium, such as air or water, as previously set forth. The inner member 30 may be a separate and discrete structure from the outer member 32 (but for being directly coupled together via the anchor line 20 along the foundation of the inflatable dam 10). In this manner, with the inner and outer members 30, 32 being coupled together at the foundation of the inflatable dam 10, the inner member 30 may be moveable within the outer member 32 so as to provide give or adjust relative to the outer member 32 should potential sharp debris puncture through the reinforcement element 50 of the outer member 32. In one embodiment, the anchor line 20 of the inflatable dam 10 may extend along the lower foundation portion 7 as a single anchor line, as depicted. In another embodiment, depending on sizing requirements, the anchor line 20 may extend with double anchor lines, such as the depicted anchor line 20 extending along the lower foundation portion 7 and another anchor line extending, for example, parallel to the depicted anchor line 20 along the lower foundation portion 7, or any other variation/configuration of anchor line layouts extending along the foundation structure 5, as may be necessary due to sizing requirements or any other requirements or specifications desired or needed for a given inflatable dam 10.

The inner member 30 may define a inner fin structure 56 that may extend along an entire length of the inner member 30. The inner fin structure 56 of the inner member 30 may be formed by employing a heat process similar to forming the fin structure 40 of the outer member 32. The inner fin structure 56 may be sized and configured to be disposed within the crevice 44 or channel on the interior side of the fin structure 40 of the outer member 32. Such inner fin structure 56 of the inner member 30 may be employed to maintain alignment of the inner member 30 relative to the outer member 32. In this manner, with the water being held by the dam and often providing various pressures and various amounts of water flowing-over the dam 10, the inner fin structure may assist in maintaining alignment between the inner member 30 and the outer member 32 upon inflation and deflation of the dam.

As set forth, the inner member 30 may be a polymeric rubber material, such as vulcanized neoprene/EPDM rubber. In a further embodiment, the inner member 30 may include an inner reinforcement element 58 (shown as dashed line) in FIG. 1A. The inner reinforcement element 58 may include multiple layers of woven polyester reinforcing material embedded within the inner member 30, such as three to four layers of woven polyester reinforcing material. Further, the inner reinforcement element 58 may be embedded within and sized along an entire length and width of the inner member 30. With this arrangement, the outer member 32 may include the reinforcement element 50 embedded therein and the inner member 30 may include the inner reinforcement element 58 so as to provide reinforcement to the inner member 30 and also facilitate resistance to potential punctures of the inner member 30 from passing debris and/or instruments of vandalism, making the inflatable dam 10 a substantial improvement relative to durability and longevity from previous inflatable dam systems.

Figure 4:
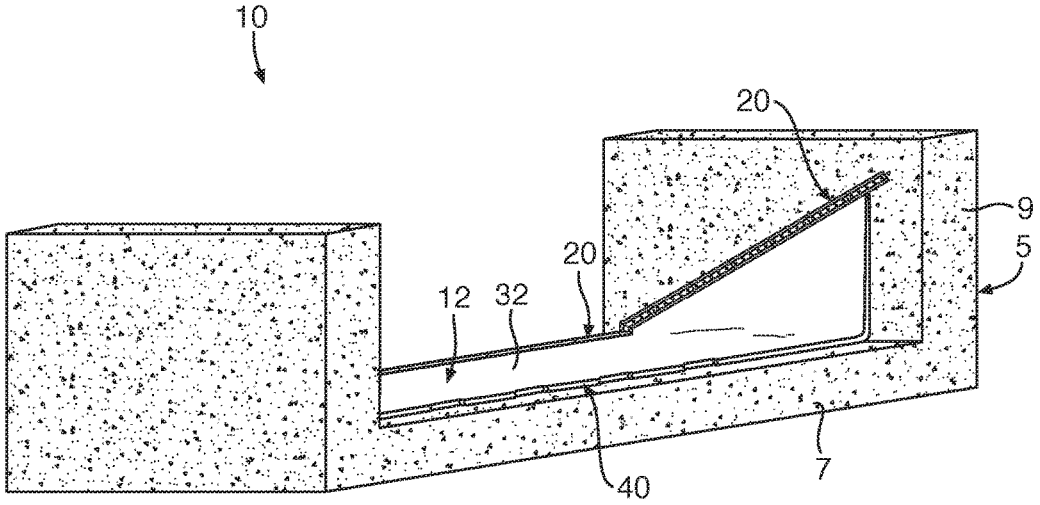
FIG. 4 is a perspective rear view or downstream view of the inflatable dam in a deflated position, according to another embodiment of the present invention.
Figure 5:
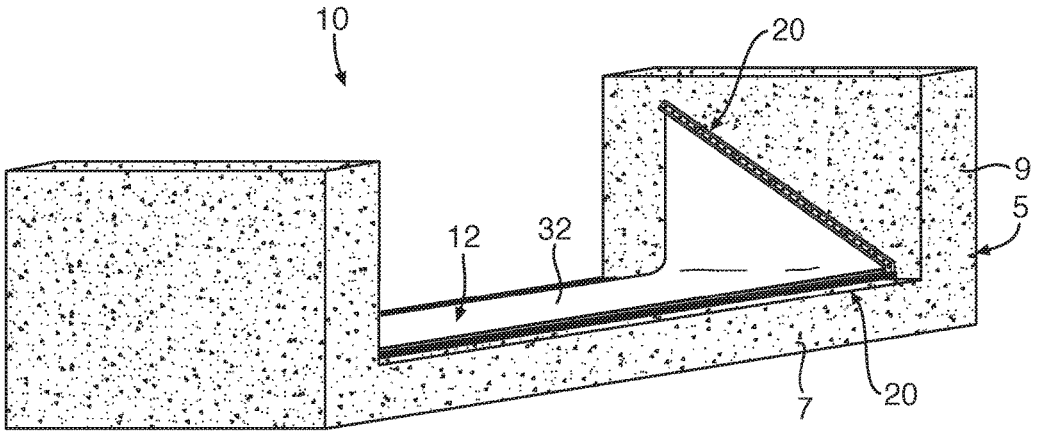
FIG. 5 is a perspective front view or upstream view of the inflatable dam in the deflated position, according to another embodiment of the present invention.
Figure 7:
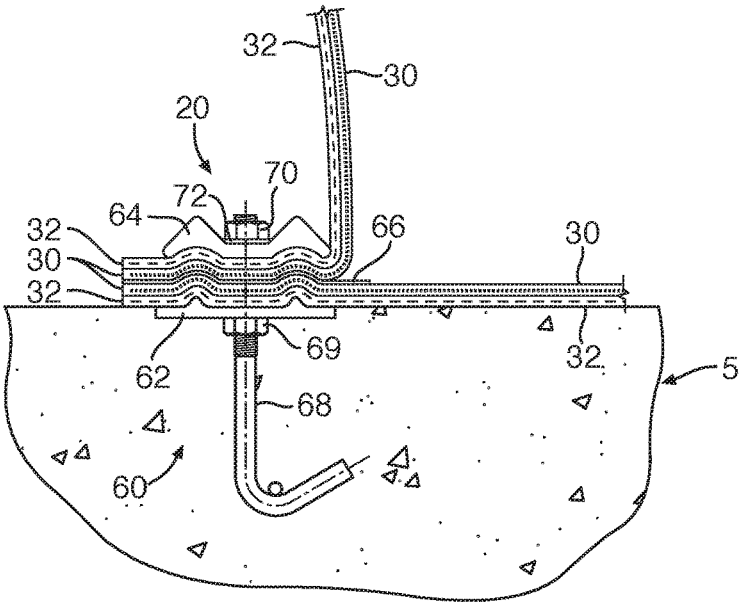
FIG. 7 is a side cross-sectional view of the anchor line assembly clamped to the foundation structure to form an anchor line for the inflatable dam, according to another embodiment of the present invention.

Now with reference to FIGS. 4, 5, and 7 depictions of respective rear and front perspective views of the inflatable dam 10 in the deflated position are provided. In the deflated position, the elongated structure 12 of the inflatable dam 10 with the inner and outer members 30, 32 may sit in a substantially flattened position. In the deflated position, the outer member 32 may be folded over with the inner member 30 such that free ends of the inner and outer members over-lap each other in a clamped and air tight manner under and along the anchor line 20 (see FIG. 7). The anchor line 20 (clamping the free ends of the inner and outer members 30, 32) may extend longitudinally along the horizontal foundation portion 7 and at a diagonal upward along each of the upstanding foundation portions 9. At the opposite side of the foundation structure 5, the fin structure 40 may extend longitudinally so as to extend and lay along a floor of the horizontal foundation portion 7 of the foundation structure 5. At opposite end portions of the elongated structure 12, including the inner and outer members 30, 32, of the inflatable dam 10, such end portions may fold upward so as to extend upward and along the oppositely facing upstanding foundation portions 9 to angled portions of the anchor line 20. In this manner, the inflatable dam 10 may extend in a flat configuration over the foundation structure 5 in the deflated position.

Figure 6:
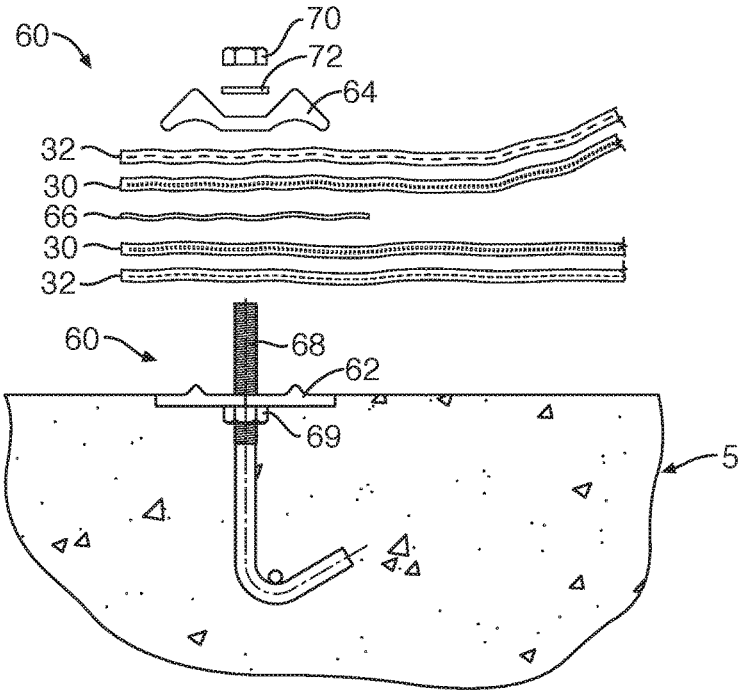
FIG. 6 is an exploded side cross-sectional view of an anchor line assembly for anchoring the inflatable dam to the foundation structure, according to another embodiment of the present invention.

With reference to FIGS. 5, 6, and 7, one embodiment for installing the inflatable dam 10 will now be described. Upon positioning the inner and outer members 30, 32 over the foundation as desired, each of the loose ends of the folded-over inner and outer members 30, 32 may be positioned to be aligned and over-lap each other such that the inflatable dam 10 may be prepared and aligned for coupling to the foundation structure 5 with an anchor line assembly 60 to form the before discussed anchor line 20.

In one embodiment, the anchor line assembly 60 may include first and second plate members 62, 64, a sealing member 66, anchor bolts 68 with leveling nuts 69, anchor nuts 70 and washers 72. The anchor line assembly 60 may include other components that may be suitable for fastening the inflatable dam 10 to the foundation structure 5. The first and second plate members 62, 64 may be employed as clamping structures that may be formed from galvanized cast steel or any other suitable material as known in the art. In one embodiment, the first and second plate members 62, 64 may be elongated and extend linearly and may include multiple first plate members 62 and multiple second plate members 64. The sealing member 66 may be an air sealing rubber sheet made from one or more polymeric materials. For example, the air sealing rubber sheet may be an un-vulcanized neoprene/EPDM rubber. The sealing member 66, such as the air sealing rubber sheet may be formed as a thin elongated strip sized to be positioned between the loose ends of the inner member 30. Further, sealing member 66 may extend along the entire anchor line 20 to be employed as an air sealing gasket for the bladder or inner member 30. The anchor bolts 68, anchor nuts 70, and washers 72 may be formed from galvanized cold drawn steel or stainless steel (or galvanized weldable grade steel, such as ASTM A307 or similar) and may be sized for securing and tightening the inflatable dam 10 to the foundation structure 5. In another embodiment, the anchor line assembly 60 may be employed as described and depicted, but without the sealing member 66.

As set forth, upon positioning and aligning the loose ends of the inner and outer members 30, 32 along the foundation structure, the sealing member 66 may be positioned between the loose ends of the inner member 30. In addition, the first plate members 62 may be positioned directly against the foundation structure 5 and under each of the loose ends of the inner and outer members 30, 32. The second plate members 64 may be positioned over each of the loose ends of the outer and inner members 32, 30. The first and second plate members 62, 64 may define apertures such that the apertures of the first plate members 62 may align with the apertures of the second plate members 64. The anchor bolts 68 may be secured to the foundation structure with, for example, epoxy if the foundation is a pre-existing structure or the anchor bolts 68 may be pre-set as the foundation is being formed.

In one embodiment, the inflatable dam 10 may be secured to the foundation structure with the anchor line assembly 60 by positioning the first plate members 62 over each of the anchor bolts 68 secured to the foundation structure 5. The loose ends of the outer and inner members 32, 30 may then be positioned over the secured anchor bolts 68 along with the sealing member 66 disposed between the loose ends of the inner member 30. The second plate members 64 may then be positioned over the bolts 68, after which, the washers 72 and nuts 70 may be tightened over the anchor bolts 68 and the second plate members 64. With this arrangement, the second plate members 64 may be employed to clamp down against the loose ends of the outer and inner members 32, 30 to securely anchor the inflatable dam 10 to the foundation and create a seal via the sealing member 66 so that the inner member 30 may be employed as an air tight bladder that may be selectively inflated and deflated, as desired.

Figure 8:
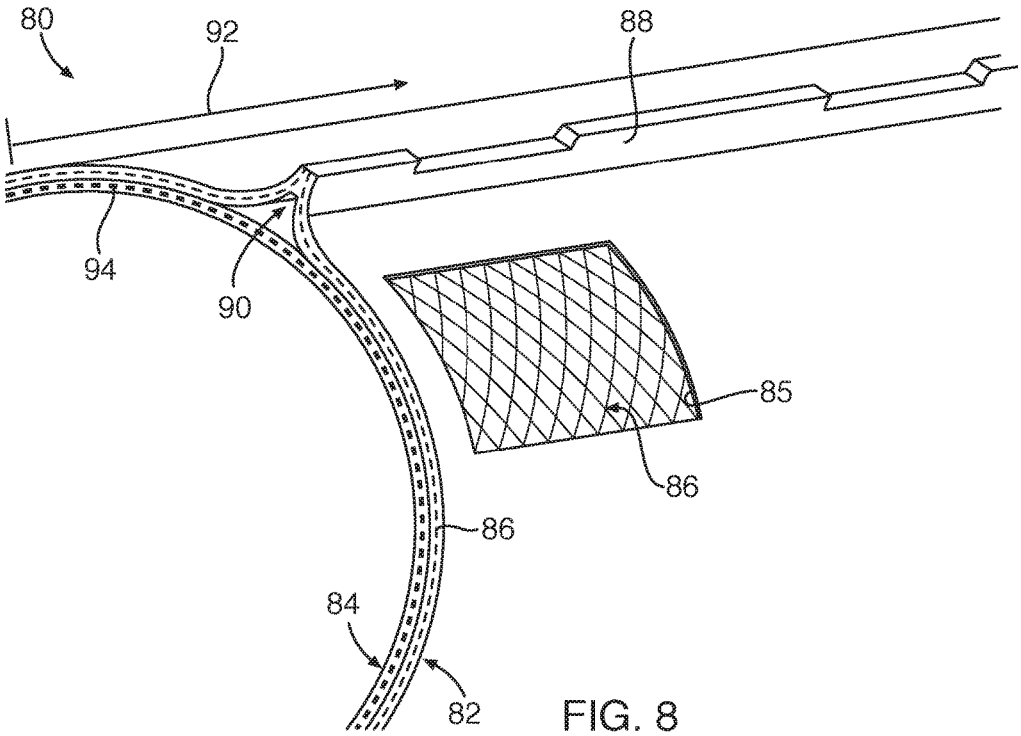
FIG. 8 is an enlarged view of another embodiment of the inflatable dam, depicting the inflatable dam with an inner member without a fin structure, according to the present invention.

With reference to FIG. 8, another embodiment of an inflatable dam 80 is provided. This embodiment is similar to the previous embodiments set forth and described relative to FIGS. 1-7, except this embodiment does not include the before described inner fin structure. Similar to the previous embodiment, the inflatable dam 80 may include an outer member 82 and an inner member 84 with a reinforcement element 86 embedded in the outer member 82. The reinforcement element 86 is shown in the cut-out portion 85 depicted in the outer member 82 and also is represented by a dashed line. Further, the outer member may include a fin structure 88. As previously set forth, the inner member 84 of the inflatable dam 80 of this embodiment does not extend with an inner fin structure. Rather, the inner member 84 extends continuously below the fin structure 88 of the outer member 82 to define a gap 90 between the inner member 84 and the fin structure 88 of the outer member 82. Such gap 90 may extend, at least partially, along a length 92 of the outer member 82 or fin structure 88 of the outer member 82. As set forth in previous embodiments, the inner member 84 may include an inner reinforcement element 94 embedded within the inner member 84, as shown by a dashed line. With this arrangement, the inflatable dam 80 of this embodiment includes multiple layers, the outer member 82 of the multiple layers having the reinforcement element 86 sized and configured to protect the inner member 84 from sharp objects and potential vandalism. Further, the inner member 84 also may include the inner reinforcement element 94 to further protect puncturing the inner member 84 from sharp objects and potential vandalism.

Figure 9:
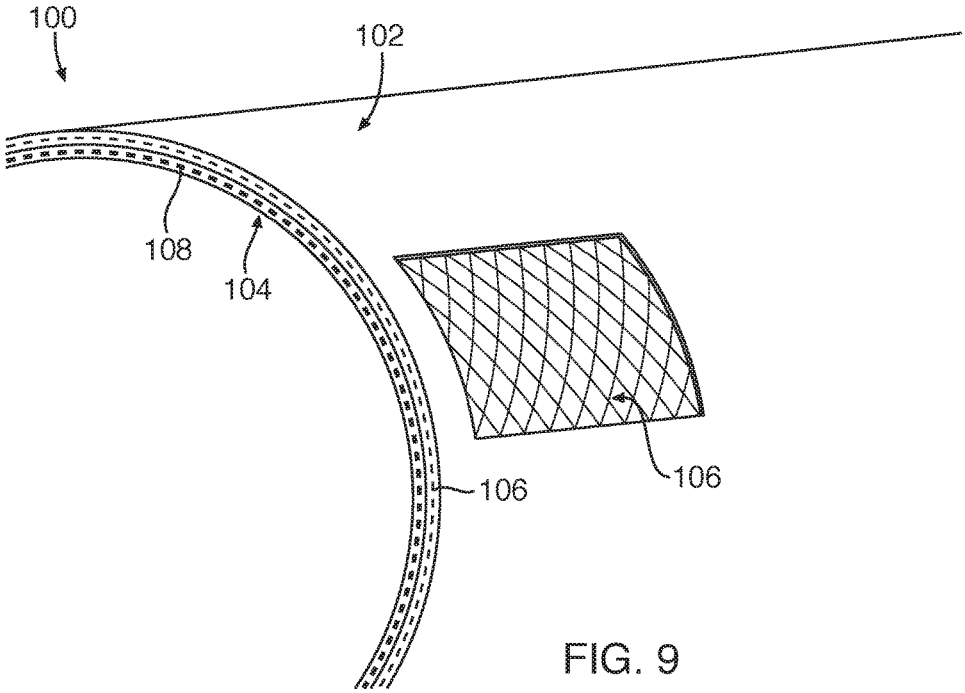
FIG. 9 is an enlarged view of another embodiment of the inflatable dam, depicting the inflatable dam having an outer member and an inner member each without a fin structure, according to the present invention.

Now with reference to FIG. 9, another embodiment of an inflatable dam 100 is provided. This embodiment is similar to the previous embodiments described and depicted relative to FIGS. 1-7, except this embodiment of the inflatable dam 100 does not include fin structures extending from either outer or inner members of the inflatable dam. Similar to the previous embodiments described herein, the inflatable dam 100 may include multiple layers. The inflatable dam may include an outer member 102 and an inner member 104, the inner member 104 extending within the outer member 102 and configured to be the bladder of the inflatable dam to hold air or fluid. Further, similar to the previous embodiments, the outer member 102 may include a reinforcement element 106 embedded within the outer member 102, shown in the cut-out portion as well as by a dashed line. Also, the inner member 104 may include an inner reinforcement element 108, depicted with a dashed line. In this manner, the reinforcement element 106 of the outer member 102 and the inner reinforcement element 108 of the inner member 104 may facilitate protecting the inner member 104 from being punctured from sharp objects and potential vandalism.

While the invention may be susceptible to various modifications and alternative forms, specific embodiments have been shown by way of example in the drawings and have been described in detail herein. Further, the structural features of any one embodiment disclosed herein may be combined or replaced by any one of the structural features of another embodiment set forth herein. As such, it should be understood that the invention is not intended to be limited to the particular forms disclosed. Rather, the invention includes all modifications, equivalents, and alternatives falling within the spirit and scope of the invention as defined by the following appended claims.

What is claimed is:

1. An inflatable dam for securing to a foundation, comprising:

an elongated inner tubular member configured to extend between upward extending walls of the foundation, the elongated inner tubular member extending to define a fin structure along a length of the elongated inner tubular member; and an elongated outer tubular member configured to extend between the upward extending walls of the foundation, the elongated inner tubular member configured to be inflated within the elongated outer tubular member such that the outer tubular member substantially surrounds the elongated inner tubular member in a concentrically aligned manner, the elongated outer tubular member including a reinforcement element embedded therein, wherein upon the elongated inner tubular member being inflated, the elongated outer tubular member extends to define an elongated channel along an interior surface thereof such that the fin structure extends to be aligned and correspond with the elongated channel so as to engage the interior surface defining the elongated channel.

2. The inflatable dam of claim 1, wherein the reinforcement element comprises a metallic mesh element.

3. The inflatable dam of claim 1, wherein the reinforcement element comprises a high strength polymeric material.

4. The inflatable dam of claim 1, wherein the reinforcement element comprises a high strength fabric.

5. The inflatable dam of claim 1, wherein the reinforcement element extends through the elongated outer tubular member such that the reinforcement element substantially surrounds an outer surface of the elongated inner tubular member.

6. The inflatable dam of claim 1, wherein the outer tubular member comprises an outer fin structure extending along a length of an exterior surface of the outer tubular member, the outer fin structure defining the elongated channel extending along an underside of the outer fin structure along an interior side of the outer tubular member.

7. The inflatable dam of claim 1, wherein the inner tubular member and the outer tubular member comprise a polymeric material.

8. The inflatable dam of claim 1, wherein the inner tubular member comprises a woven fabric reinforcing material embedded within a rubber membrane.

9. The inflatable dam of claim 1, wherein the outer tubular member is secured to the foundation with an anchor line.

10. An inflatable dam for securing to a foundation, comprising:

a double layered flexible membrane extending with an inner tubular membrane and an outer tubular membrane, the double layered flexible membrane including a port configured to facilitate inflation and deflation of the inner tubular membrane such that, upon inflation of the inner tubular membrane, the outer tubular membrane is configured to expand with inflation of the inner tubular membrane such that the inner tubular membrane is substantially concentrically aligned relative to the outer tubular membrane, the outer tubular membrane including a reinforcement element embedded therein;

wherein the inner tubular membrane includes a fin structure extending along a length thereof, the fin structure sized and configured to be aligned and engage with an elongated crevice defined on an interior side of the outer tubular membrane.

11. The inflatable dam of claim 10, wherein the reinforcement element comprises a metallic wire mesh element.

12. The inflatable dam of claim 10, wherein the reinforcement element comprises a wire mesh member.

13. The inflatable dam of claim 10, wherein the reinforcement element comprises a high strength polymeric material.

14. The inflatable dam of claim 10, wherein the reinforcement element comprises a high strength fabric.

15. The inflatable dam of claim 10, wherein the outer tubular membrane surrounds an entire outer surface of the inner tubular membrane.

16. The inflatable dam of claim 10, wherein the reinforcement element surrounds an entire outer surface of the inner tubular membrane.

17. The inflatable dam of claim 10, wherein the inner tubular membrane comprises a fabric-reinforced rubber membrane.

18. The inflatable dam of claim 10, wherein the outer tubular membrane comprises an outer fin structure extending along a length of an exterior surface of the outer tubular membrane, the outer fin structure defining the elongated crevice extending along an underside of the fin structure and along the interior side of the outer tubular membrane.

19. A method for damming water flow, the method comprising:

providing a double layered flexible membrane over a foundation structure, the double layered flexible membrane having an inner tubular membrane and an outer tubular membrane, the outer tubular membrane having a reinforcement element embedded therein such that the reinforcement element substantially surrounds the inner tubular membrane, the double layered flexible membrane coupled to the foundation; and inflating the double layered flexible membrane through a port defined therein;

wherein the inflating comprises substantially maintaining concentric alignment of the inner tubular membrane relative to the outer tubular membrane with an inner fin structure extending along a length of the inner tubular membrane to be positioned within a crevice defined along an interior surface of the outer tubular membrane.

20. The method according to claim 19, wherein the providing comprises providing a metallic mesh as the reinforcement element.

21. The method according to claim 19, wherein the providing comprises providing a high strength polymeric material as the reinforcement element.

22. The method according to claim 19, wherein the providing comprises providing a high strength fabric as the reinforcement element.

* * * * *